United States Patent [19]

Buske

[11] Patent Number: 4,724,911

[45] Date of Patent: Feb. 16, 1988

[54] HYDRAULIC IMPACT TOOL

[75] Inventor: Robert J. Buske, Corsicana, Tex.

[73] Assignee: Enmark Corporation, Denver, Colo.

[21] Appl. No.: 811,865

[22] Filed: Dec. 20, 1985

[51] Int. Cl.[4] ..... B25D 9/00

[52] U.S. Cl. ..... 173/119; 173/134; 91/238

[58] Field of Search ..... 173/17, 115, 119–121, 173/134–136; 91/238, 308, 453

[56] References Cited

U.S. PATENT DOCUMENTS

| | | | |
|---|---|---|---|
| 3,866,690 | 2/1975 | Lance et al. | 173/134 |
| 3,995,700 | 12/1976 | Mayer et al. | 91/308 |
| 4,062,411 | 12/1977 | Adkins et al. | 173/115 |
| 4,181,183 | 1/1980 | Okada | 173/119 |
| 4,231,434 | 11/1980 | Justus | 173/134 |
| 4,413,687 | 11/1983 | Eklof | 173/134 |
| 4,474,248 | 10/1984 | Musso | 173/17 |

FOREIGN PATENT DOCUMENTS 1550520 8/1979 United Kingdom .

*Primary Examiner*—Paul A. Bell
*Assistant Examiner*—James L. Wolfe
*Attorney, Agent, or Firm*—Gunn, Lee & Jackson

[57] ABSTRACT

A hydraulic impact tool having a housing, a working tool, a ram, an energy storage device, and a valve slide. The tool also has a high pressure hydraulic fluid inlet port, an intermediate pressure hydraulic fluid inlet port, and one or two return lines. If there are two return lines, one of the return lines is for exhausting fluid from an upper annular chamber, and the other return line is for exhausting fluid from an intermediate annular chamber. The tool also has an optional delatch outlet, which can be opened and closed externally by the operator of the tool. The tool may also have a piston portion on the ram to restrict fluid flow between the ram and the valve slide as the ram is accelerated toward the working tool.

8 Claims, 5 Drawing Figures

HYDRAULIC IMPACT TOOL

BACKGROUND OF THE INVENTION

1. Field of the Invention

This invention relates in general to hydraulic tools, and in particular to tools for converting energy into a series of rapid, high energy impact blows.

2. Description of the Prior Art

Hydraulic impact tools generally have an energy storage device, such as a coil spring or gas spring, a ram, and a working tool. The energy storage device causes the ram to accelerate to deliver a blow to the working tool. Impact tools are normally used for demolition purposes, such as breaking concrete, pavement, or ice, or for cutting asphalt. These tools can also be used for other jobs, such as compacting soil or driving pipe, posts, or pilings.

One type of impact tool is described in U.S. Pat. No. 4,231,434 (Justus), issued Nov. 4, 1980. In that tool, the ram has a piston portion, which sealingly engages a sleeve to define a piston. Hydraulic pressure pushes the defined piston away from the working tool, to cock the ram, and to store energy by compressing a gas spring. At the top of the stroke, the piston portion of the ram separates from the sleeve, and the ram is accelerated to impact by the gas spring. A coil spring initiates downward movement of the sleeve, and hydraulic pressure returns the sleeve to sealing engagement with the piston portion of the ram.

U.S. Pat. No. 4,413,687 (Eklof) shows a hydraulic impact device in which the blow rate and the impact energy can be adjusted externally. The tool has a valving pin, which is slidable in a bore. The bore intersects a plurality of branches of two control lines. The branches of the two control lines are deactivated in a predetermined bound relationship to each other.

SUMMARY OF THE INVENTION

The hydraulic impact tool of the invention utilizes a novel method of adjusting the blow rate and the impact energy externally. The improved hydraulic impact tool has two separate return line fluid outlet ports for exhausting fluid from the intermediate annular chamber. The tool also has externally operated means for selectively opening and closing one of the outlet ports.

The first port exhausts fluid from the intermediate annular chamber at the normal time during the operational cycle of the tool. This first port remains open at all times. The second port is longitudinally offset from the first port, and exhausts the fluid at an earlier point during the operational cycle, resulting in a higher blow rate and a lower impact energy.

DESCRIPTION OF THE PREFERRED EMBODIMENT

Figure 1:
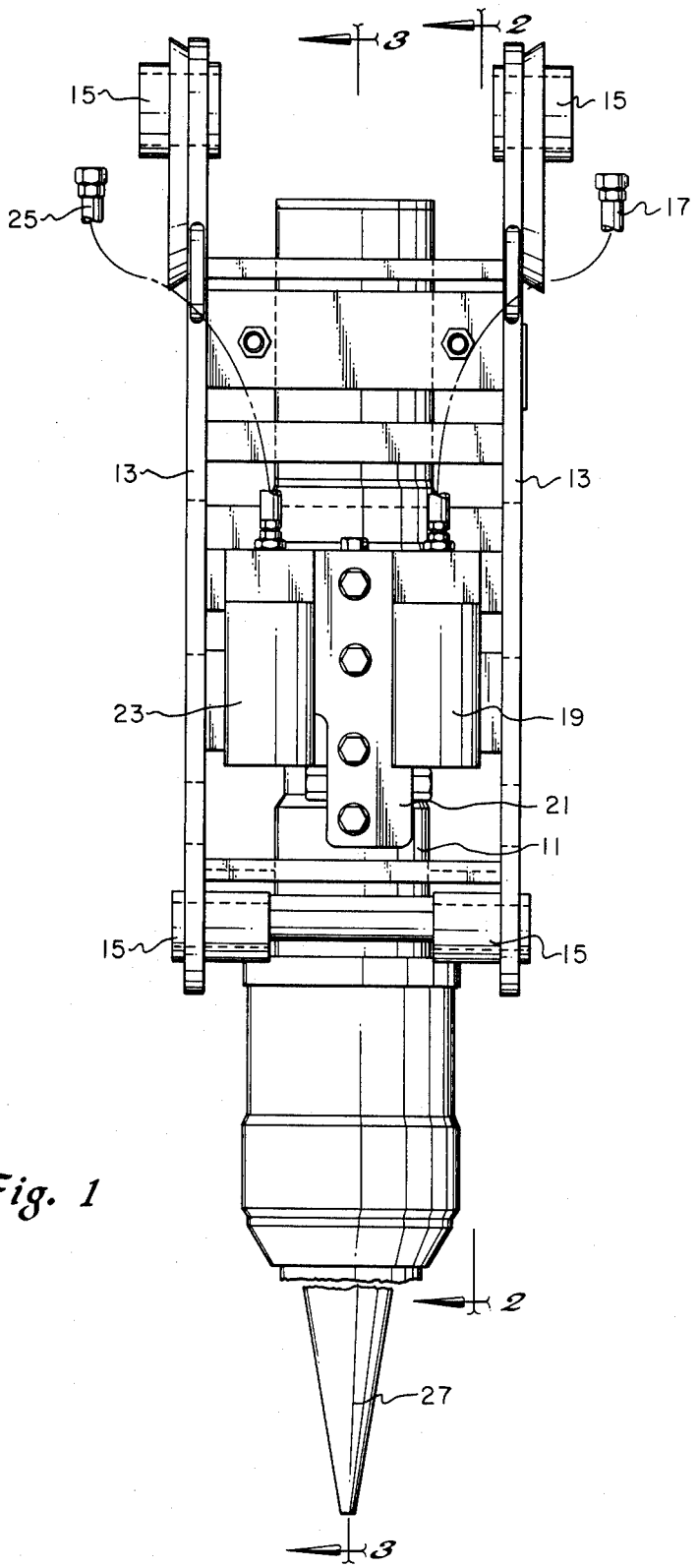
FIG. 1 is a side view of an improved hydraulic impact tool.
Figure 2:
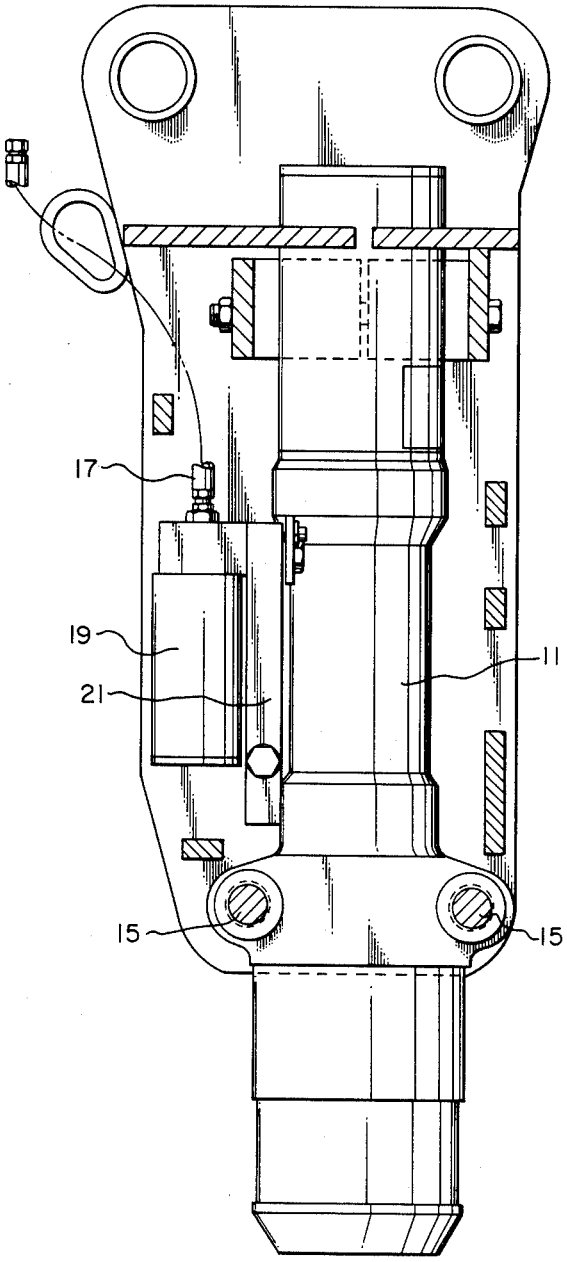
FIG. 2 is a sectional view of an impact tool as seen along lines 2—2 in FIG. 1.

FIGS. 1 and 2 show a hydraulic impact tool 11, mounted between a pair of adapter plates 13. The adapter plates 13 are attached to a tractor or backhoe (not shown) by several pins (not shown), which pass through bushings 15. A hose assembly 17 delivers hydraulic fluid from a fluid source, through an accumulator 19, to a manifold assembly 21 on the impact tool 11. The hydraulic fluid is returned to the source through a second accumulator 23 and a second hose assembly 25.

Figure 3A:
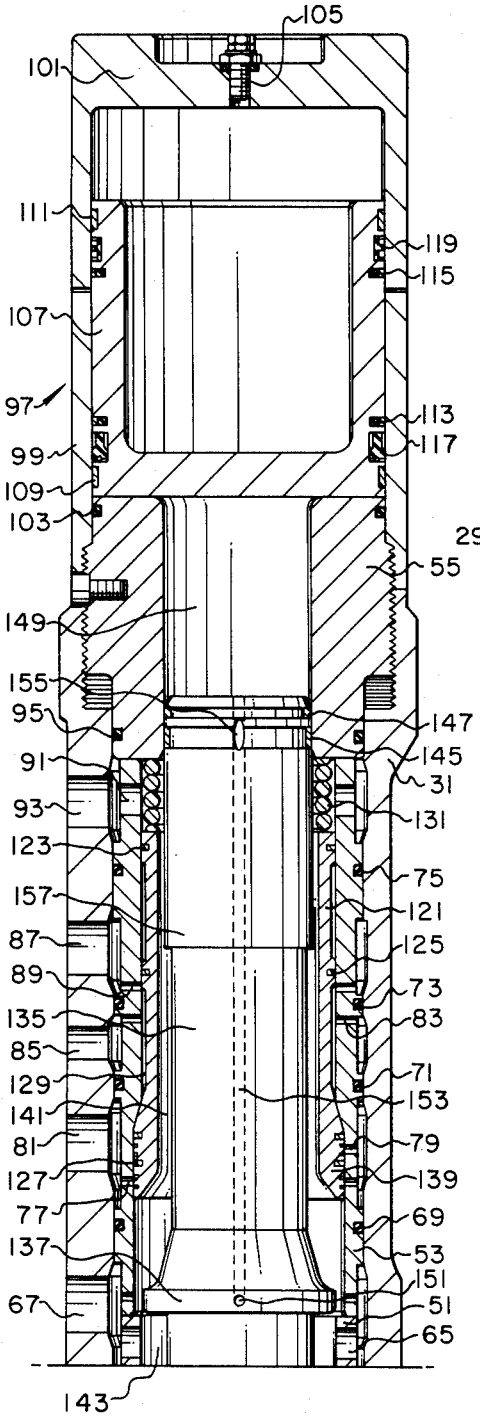
FIGS. 3A and 3B are a sectional view of an impact tool.
Figure 3B:
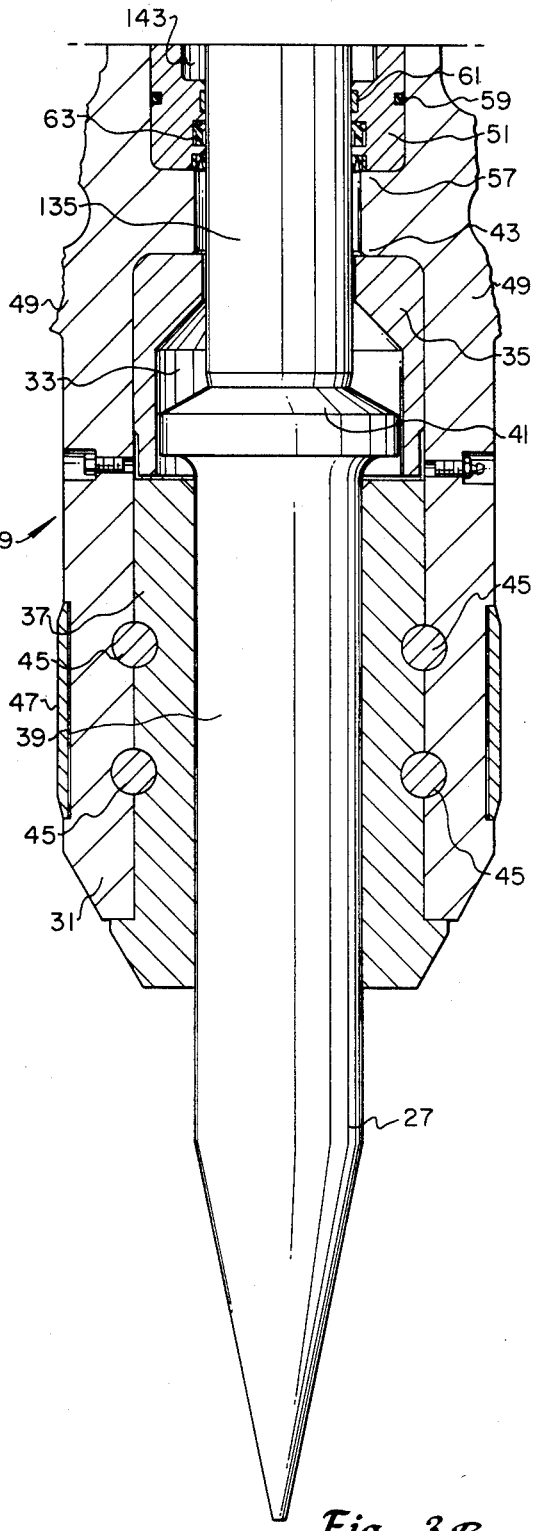

In FIG. 3B, a typical working tool 27 is shown mounted in the housing 29 of the hydraulic impact tool 11. Typical working tools are moils, tampers, spades, or post drivers. The housing 29 has an outer casing 31, which has a generally cylindrical bore 33.

The working tool 27 is mounted in the housing 29 by first inserting a preload bushing 35 into the bore 33 of the casing 31. A tool guide 37 is placed around the shaft 39 of the working tool 27, and the working tool 27 is inserted into the bore 33 of the casing 31, until a knob 41 on the top of the working tool 27 contacts the preload bushing 35 and the preload bushing 35 contacts a shoulder 43 in the casing 31. The entire assembly is then secured by four tool retainer pins 45 and a pin retainer ring 47.

The casing 31 also has a pair of attachment flanges 49, which are partially shown in FIG. 3B, but have been broken off for clarity. These attachment flanges 49 are connected to the adapter plates (shown in FIGS. 1 and 2), which are used to attach the impact tool 11 to a tractor-backhoe, excavator, or other similar vehicle. The casing 31 and the flanges 49 may be integral if made from a casting or the like.

In addition to the casing 31, the housing 29 also has three generally cylindrical sleeves: a lower sleeve 51, a middle sleeve 53, and an upper sleeve 55. The lower sleeve 51, shown in FIGS. 3A and 3B, abuts a shoulder 57 in the casing 31. An o-ring seal 59 seals between the lower sleeve 51 and the casing 31. A wear ring 61 and a seal assembly 63 are located in grooves on the inner circumference of the lower sleeve 51. The seal assembly 63 consists of a seal, a backup ring, a retaining ring, and a rod wiper.

As shown in FIG. 3A, a plurality of ports 65 allow fluid passage through the lower sleeve 51. Hydraulic fluid, at an intermediate pressure, is supplied to the ports 65 through a hydraulic fluid inlet 67. Hydraulic fluid, at an intermediate pressure, is thus supplied to the bore 33 of the casing 33 through the ports 65 in the lower sleeve 51.

The middle sleeve 53 has four o-ring seals 69, 71, 73, and 75, which seal between the middle sleeve 53 and the casing 31. One or more ports 77 allow fluid flow through the middle sleeve 53, between the lower two of these o-ring seals 69, 71. The middle sleeve 53 also has a bleed orifice hole 79, slightly above the ports 77. A second hydraulic fluid inlet 81 allows fluid pressure at a high pressure to be supplied to the bore 33 of the casing 31, through the ports 77.

Another plurality of ports 83, allows fluid to be exhausted from within the middle sleeve 53, between the middle two o-ring seals 71, 73. The fluid then exits through an optional delatch outlet 85, if the optional delatch outlet is open. The optional delatch outlet 85 is opened and closed by the manifold 21, in a manner to be described later.

A second delatch outlet 87 allows fluid to be exhausted from within the middle sleeve 53 through a different plurality of ports 89. These ports 89 are located between the upper two o-rings 73, 75. Unlike the optional delatch outlet 85, this delatch outlet 87 is open at all times.

Above the four o-ring seals 69, 71, 73, and 75, a plurality of ports 91 allows fluid to flow through the middle sleeve 53, and out a return outlet 93. Hydraulic fluid is thus exhausted from the bore 33 of the casing 31, through the ports 91 and the return outlet 93.

The upper sleeve 55 is threaded into the upper end of the casing 31. The upper sleeve 55 abuts the middle sleeve 53 and locks the middle sleeve 53 and the lower sleeve 51 in place. An o-ring seal 95 seals between the upper sleeve 55 and the casing 31.

An energy storage device 97 is mounted in the upper end of the hydraulic impact tool. This device may be a coil spring or a gas spring, but in the preferred embodiment the energy storage device is a hydraulic actuator 97. The actuator 97 has an outer cylinder 99 and a closed upper end 101. The outer cylinder 99 is threaded onto the upper sleeve 55, until the outer cylinder 99 abuts the casing 31. An o-ring seal 103 seals between the cylinder 99 and the upper sleeve 55.

A gas, such as nitrogen, is injected into the energy storage device 97 through a filler valve 105 in the upper end 101 of the cylinder 99. A cup-shaped piston 107 is reciprocally located within the cylinder 99. The piston 107 has a pair of wear rings 109, 111, a pair of piston rings 113, 115, and a pair of seals 117, 119 between the piston 107 and the inner circumference of the cylinder 99. The piston 107 thus separates the gas in the upper end of the cylinder 99 from hydraulic fluid in the lower end of the cylinder 99.

A valve slide 121 is located in the bore 33 within the middle sleeve 53. The valve slide 121 is reciprocal between a lower position and an upper position. In the mid-portion of the valve slide 121, the outside diameter of the valve slide 121 is smaller than the inside diameter of the middle sleeve 53. At each end, however, the outer circumference of the valve slide 121 is sealed against the inner circumference of the middle sleeve 53. The valve slide 121 has a piston ring 123 at the upper end, a piston ring 125 in the middle, and a seal 127 at the lower end. The lower seal 127 may consist of a piston ring, or labyrinth grooves, or a combination of both piston rings and labyrinth grooves.

An intermediate annular chamber 129 is thus formed between the valve slide 121 and the middle sleeve 53. When the valve slide 121 is in its lower position, the intermediate annular chamber 129 is opened to the port or ports 77 and the high pressure fluid inlet 81.

When the valve slide 121 is in its upper position, the piston ring 125 on the valve slide 121 reaches the ports 89, and the intermediate annular chamber is opened to the delatch port 87. Also, a coil spring 131 is compressed between the valve slide 121 and the upper sleeve 55, when the valve slide 121 is in its upper position.

A spool, or ram 135, is also located within the bore 33 of the impact tool 11. The ram 135 is reciprocal between a lower position and an upper position. When the ram 135 reaches the lower position, the bottom of the ram 135 strikes the top of the working tool 27. The outside diameter of the lower end of the ram 135 is equal to the inside diameter of the wear ring 61 and the seal assembly 63 on the lower sleeve 51. The seal assembly 63 thus seals between the ram 135 and the lower sleeve 51.

The ram 135 has a piston portion 137, which has a larger diameter than the rest of the ram 135. The diameter of the piston portion 137 is larger than the inside diameter of the valve slide 121, but smaller than the inside diameter of the middle sleeve 53. The piston portion 137 of the ram 135 sometimes sealingly engages a lower sealing portion 139 of the valve slide 121.

Above the piston portion 137, the diameter of the ram 135 decreases to a diameter which is less than the inside diameter of the valve slide 121, forming an upper annular chamber 141 between the ram 135 and the valve slide 121. When the valve slide 121 and the ram 135 are sealingly engaged, the bore 33 is thus divided into three annular chambers: the upper annular chamber 141, the intermediate annular chamber 129, and a lower annular chamber 143, which is between the ram 135 and the lower sleeve 51. The upper annular chamber 141 is always open to the return outlet 93 through the ports 91.

At the upper end of the ram 135, the diameter of the ram 135 increases to a diameter which is equal to the inside diameter of the upper sleeve 55. The ram 135 has a wear ring 145 to maintain the diameter, and a piston ring 147 to seal between the ram 135 and the inner circumference of the upper sleeve 55. A sealed chamber 149 is thus formed between the top of the ram 135 and the bottom of the piston 107. However, when the ram is in its lower position, the chamber 149 is opened to fluid contact with the return outlet 93.

A small hole 151 in the piston portion 137 of the ram 135 leads from the lower annular chamber 143 to a duct 153, which extends up the center of the ram 135 to an orifice 155. The orifice 155 allows hydraulic fluid from the lower annular chamber 143 to replenish the hydraulic fluid in the chamber 149.

Within the valve slide 121, the ram 135 has a shoulder portion 157 with a larger diameter. The diameter of the shoulder portion 157 is only slightly smaller than the inside diameter of the valve slide 121. In some embodiments, the valve slide 121 may have a section with a smaller inside diameter, which will pass the shoulder portion 157 during the operation of the impact tool.

Figure 4:
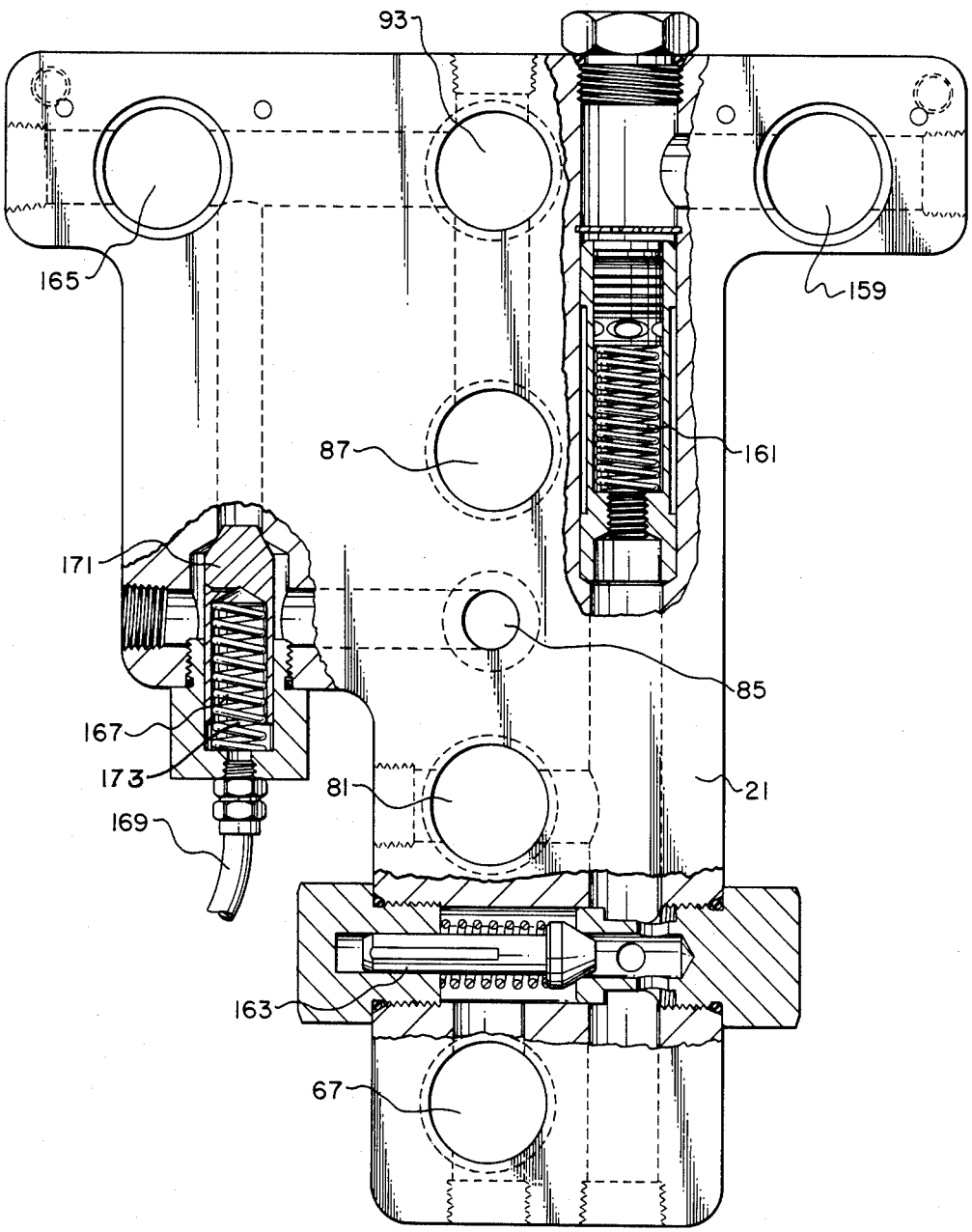
FIG. 4 is a side view, partially in section, of a manifold on an impact tool.

FIG. 4 illustrates the manifold 21, which regulates the flow of hydraulic fluid into and out of the impact tool 11. The hydraulic fluid flows from the hose assembly 17, through the accumulator 19, and into the manifold 21 through an entrance port 159. The fluid then flows through a flow restrictor 161, which limits the flow of fluid into the impactor 11.

The fluid then flows downward through the manifold 21, and some of the fluid enters the high pressure inlet port 81. The remainder of the fluid flows through a pressure regulator 163, which reduces the pressure of the fluid. The intermediate pressure fluid then enters the intermediate pressure inlet port 67.

Hydraulic fluid exiting through the return outlet 93 or the delatch outlet 87 flow through the manifold 21 to an outlet 165. The fluid then flows through the second accumulator 23 and the hose assembly 25.

The optional delatch outlet 85 is opened and closed by an externally operated hydraulic valve 167. When fluid pressure is applied to the valve 167 through a hose 169, a plunger 171 closes off the optional delatch outlet 85. When the pressure is removed, a spring 173 moves the plunger 171 to open the valve 167. Fluid can then exit through the open optional delatch outlet 85. The fluid then exits the manifold 21 through the outlet 165. The valve 167 is thus an externally operated selection means for opening and closing the optional delatch outlet 85.

The operation of the impact tool will be described starting with the ram 135 and the valve slide 121 in their lowermost positions, and with the optional delatch outlet closed. High pressure hydraulic fluid is applied through the fluid inlet 81, and the ports 77, to the intermediate annular chamber 129. The fluid pressure holds the valve slide 121 in sealing engagement with the piston portion 137 of the ram 135.

At the same time, intermediate pressure hydraulic fluid is applied through the fluid inlet 67, and the ports 65, into the lower annular chamber 143. Since the intermediate pressure fluid is acting against a much larger area than the high pressure fluid, the ram 135 and the valve slide 121 are forced upward, away from the working tool 27.

As the ram 135 moves upward, the hydraulic fluid in the chamber 149 pushes upward on the piston 107, compressing the gas in the upper portion of the cylinder 99. Since the area of the bottom of the piston 107 is four times the area of the top of the ram 135, the piston 107 will only move one-fourth as far as the ram 135.

As the valve slide 121 approaches the top of its travel, the valve slide 121 compresses the coil spring 131. As the piston 107 compresses the gas and the valve slide 121 compresses the spring 131, energy is stored in the energy storage means 97 and in the spring 131.

When the ram 135 and the valve slide 121 have reached a certain position, the piston ring 125 reaches the ports 89, and loses sealing engagement with the middle sleeve 53. At approximately the same time, the lower end of the valve slide 121 covers the port or ports 77 to the high pressure fluid inlet 81. The intermediate annular chamber 129 is opened to the delatch outlet 87. The return outlet 93 and the delatch outlet 87 are thus outlet means for exhausting fluid from the upper annular chamber 141 and the intermediate annular chamber 129.

Since the intermediate chamber 129 is now open to the delatch outlet 87, there is no longer any high pressure fluid exerting a downward force on the valve slide 121. The valve slide 121 jumps upward, breaking the sealing engagement with the piston portion 137 of the ram 135.

When the sealing engagement between the valve slide 121 and the ram 135 is broken, the lower annular chamber 143 is opened to fluid contact with the upper annular chamber 141. The upward force on the piston downward until the ram 135 strikes the working tool 27. The fluid actuator 97 is thus an energy storage means for accelerating the ram 135 to deliver a blow to the working tool 27 when the ram 135 is released.

The purpose of the shoulder portion 157 is to begin the downward travel of the valve slide 121. As the ram 135 travels to impact, hydraulic fluid must pass between the ram 135 and the valve slide 121. The shoulder portion 157 is a flow restriction means for restricting the flow of hydraulic fluid between the ram 135 and the valve slide 121, as the ram 135 travels toward the working tool 27. The flow restriction causes a downward force against the valve slide 121, which begins the downward travel of the valve slide 121.

Because of the bleed orifice hole 79, there is always a high pressure path on the valve slide 121. However, since the fluid passes through a small orifice hole 79, the fluid flow is restricted, and the valve slide can delatch from the piston portion 137 of the ram 135. The high pressure reduces the dwell time by placing an additional downward force on the valve slide 121. In addition to the bleed orifice hole 79 and the shoulder portion 157 on the ram 135, the coil spring 131 also exerts a downward force on the valve slide 121.

When the coil spring 131 has moved the valve slide 121 downward far enough, the piston ring 125 against makes sealing engagement with the middle sleeve 53. The ports 89 are sealed off, and the ports 77 are opened to the intermediate annular chamber 129. The high pressure hydraulic fluid from the inlet 81 forces the valve slide 121 downward until sealing engagement is restored with the piston portion 137. The tool 11 will repeat the cycle of operation as long as hydraulic pressure is applied through hose assembly 17.

If the operator desires, the blow rate of the tool 11 can be increased and the blow energy decreased. This is done by cutting off the hydraulic pressure through hose 169 to the valve 167. The plunger 171 opens the valve 167, so that fluid can exit through the optional delatch outlet 85. The valve slide 121 will now delatch, or jump upward, when the piston ring 125 reaches the the ports 83. Since the ports 83 are lower than the ports 89, delatch occurs earlier, and the tool 11 will cycle as a faster rate and at a lower blow energy.

The improved impact tool 11 of the invention has several significant advantages. The blow rate and blow energy of the tool 11 can be quickly and easily changed. There is little or no lost time when the blow rate of the tool 11 needs to be changed.

Further, the impact tool can be easily disassembled by unscrewing the energy storage device 97 and the upper sleeve 55. The middle sleeve 53, the lower sleeve 51, the valve slide 121, and the ram 135 can then be removed from the upper end of the casing 31. The working tool 27 is easily replaced from the lower end of the casing 31, as explained above. The duct 153 and the orifice 155 allow the hydraulic fluid in the chamber 149 to be circulated for cooling.

I claim:

1. A hydraulic impact tool, comprising:

a housing, having a bore;

a working tool, one end of the working tool being mounted within the bore;

a ram, reciprocally disposed within the housing;

energy storage means for accelerating the ram to deliver a blow to the working tool;

a valve slide, reciprocally disposed around the ram, the valve slide having an upper sealing portion for sealingly engaging the circumference of the bore, and a lower sealing portion for sealingly engaging the ram, thereby dividing the bore into upper, intermediate, and lower chambers;

a high pressure hydraulic fluid inlet port for supplying high pressure fluid to the intermediate annular chamber to force the lower sealing portion of the valve slide into sealing engagement with the ram;

an intermediate pressure hydraulic fluid inlet port for supplying intermediate pressure fluid to the lower annular chamber to force the ram and the valve slide away from the working tool when the ram and the valve slide are in sealing engagement;

outlet means for exhausting fluid from the upper annular chamber and the intermediate annular chamber and out of the tool, wherein periodic opening of one of said outlet means causes said sealing engagement of said valve slide and said ram to be periodicially interrupted;

an optional delatch outlet for exhausting fluid from the intermediate annular chamber and out of the tool, by interrupting said sealing engagement of said valve slide from said ram; and externally operated selection means for causing the optional delatch outlet to be open or closed during operation at each predetermined blow rate.

2. A hydraulic impact tool, comprising:

a housing, having a bore;

a working tool, one end of the working tool being mounted within the bore;

a ram, reciprocally disposed within the housing;

energy storage means for accelerating the ram to deliver a blow to the working tool;

a valve slide, reciprocally disposed around the ram, the valve slide having an upper sealng portion for sealingly engaging the circumference of the bore, and a lower sealing portion for sealingly engaging the ram, thereby dividing the bore into upper, intermediate, and lower chambers;

a high pressure hydraulic fluid inlet port for supplying high pressure fluid to the intermediate annular chamber to force the lower sealing portion of the valve slide into sealing engagement with the ram;

an intermediate pressure hydraulic fluid inlet port for supplying intermediate pressure fluid to the lower annular chamber to force the ram and the valve slide away from the working tool when the ram and the valve slide are in sealing engagement;

a return outlet for exhausting fluid from the tool from the upper annular chamber;

a delatch outlet for exhausting fluid from the intermediate annular chamber and out of the tool, wherein periodic opening of said delatch outlet causes said sealing engagement of said valve slide and said ram to be periodically interrupted;

an optional delatch outlet for exhausting fluid from the intermediate annular chamber and out of the tool by interrupting said sealing engagement of said valve slide from said ram, the optional delatch outlet being longitudinally offset from the delatch outlet; and externally operated selection means for causing the optional delatch outlet to be open or closed during operation at each predetermined blow rate.

3. A hydraulic impact tool, comprising:

a housing, having a bore;

a working tool, one end of the working tool being mounted within the bore;

a ram, reciprocally disposed within the housing;

energy storage means for accelerating the ram to deliver a blow to the working tool;

a valve slide, reciprocally disposed around the ram, the valve slide having an upper sealing portion for sealingly engaging the circumference of the bore, and a lower sealing portion for sealingly engaging the ram, thereby dividing the bore into upper, intermediate, and lower chambers;

flow restriction means for restricting the flow of hydraulic fluid between the ram and the valve slide when the ram is accelerated toward the working tool;

a high pressure hydraulic fluid inlet port for supplying high pressure fluid to the intermediate annular chamber to force the lower sealing portion of the valve slide into sealing engagement with the ram;

an intermediate pressure hydraulic fluid inlet port for supplying intermediate pressure fluid to the lower annular chamber to force the ram and the valve slide away from the working tool when the ram and the valve slide are in sealing engagement;

outlet means for exhausting fluid from the upper annular chamber and the intermediate annular chamber and out of the tool, wherein periodic opening of one of said outlet means causes said sealing engagement of said valve slide and said ram to be periodically interrupted;

an optional delatch outlet for exhausting fluid from the intermediate annular chamber and out of the tool, by interrupting said sealing engagement of said valve slide from said ram; and externally operated selection means for causing the optional delatch outlet to be open or closed during operation at each predetermined blow rate.

4. A hydraulic impact tool, comprising:

a housing, having a plurality of generally cylindrical sleeves secured within an outer casing, and a bore;

a working tool, one end of the working tool being mounted within the bore;

a ram, reciprocally disposed within the housing;

energy storage means for accelerating the ram to deliver a blow to the working tool, the energy storage means being releasably secured to the housing, so that the energy storage means can be removed from the housing and the sleeves can be removed from the casing;

a valve slide, reciprocally disposed around the ram, the valve slide having an upper sealing portion for sealingly engaging the circumference of the bore, and a lower sealing portion for sealingly engaging the ram, thereby dividing the bore into upper, intermediate, and lower chambers;

flow restriction means for restricting the flow of hydraulic fluid between the ram and the valve slide when the ram is accelerated toward the working tool;

a high pressure hydraulic fluid inlet port for supplying high pressure fluid to the intermediate annular chamber to force the lower sealing portion of the valve slide into sealing engagement with the ram;

an intermediate pressure hydraulic fluid inlet port for supplying intermediate pressure fluid to the lower annular chamber to force the ram and the valve slide away from the working tool when the ram and the valve slide are in sealing engagement;

a return outlet for exhausting fluid from the tool from the upper annular chamber;

a delatch outlet for exhausting fluid from the intermediate annular chamber and out of the tool, wherein periodic opening of said delatch outlet causes said sealing engagement of said valve slide and said ram to be periodically interrupted;

an optional delatch outlet for exhausting fluid from the intermediate annular chamber and out of the tool, by interrupting said sealing engagement of said valve slide from said ram, the optional delatch outlet being longitudinally offset from the delatch outlet; and externally operated selection means for causing the optional delatch outlet to be open or closed during operation at each predetermined blow rate.

5. A hydraulic impact tool, comprising:

a housing, having a plurality of generally cylindrical sleeves secured within an outer casing, and a bore;

a working tool, one end of the working tool being mounted within the bore;

a ram, reciprocally disposed within the housing, the ram having a piston portion having a diameter smaller than the diameter of the bore;

energy storage means for accelerating the ram to deliver a blow to the working tool, the energy storage means being releasably secured to the housing, so that the energy storage means can be removed from the housing and the sleeves can be removed from the casing;

a valve slide, reciprocally disposed around the ram, the valve slide having an upper sealing portion for sealingly engaging the circumference of the bore, and a lower sealing portion for sealingly engaging the ram, thereby dividing the bore into upper, intermediate, and lower chambers;

a shoulder portion on the ram, of an increased diameter, for restricting the flow of hydraulic fluid between the ram and the valve slide when the ram is accelerated toward the working tool;

a high pressure hydraulic fluid inlet port for supplying high pressure fluid to the intermediate annular chamber to force the lower sealing portion of the valve slide into sealing engagement with the piston portion of the ram;

an intermediate pressure hydraulic fluid inlet port for supplying intermediate pressure fluid to the lower annular chamber to force the ram and the valve slide away from the working tool when the ram and the valve slide are in sealing engagement;

outlet means for exhausting fluid from the upper annular chamber and the intermediate annular chamber and out of the tool, wherein periodic opening of one of said outlet means causes said sealing engagement of said valve slide and said ram to be periodically interrupted;

an optional delatch outlet for exhausting fluid from the intermediate annular chamber and out of the tool, by interrupting said sealing engagement of said valve slide from said ram; and externally operated selection means for causing the optional delatch outlet to be open or closed during operation at each predetermined blow rate.

6. A hydraulic impact tool, comprising:

a housing, having a plurality of generally cylindrical sleeves secured within an outer casing, and a bore;

a working tool, one end of the working tool being mounted within the bore;

a ram, reciprocally disposed within the housing, the ram having a piston portion having a diameter smaller than the diameter of the bore;

energy storage means for accelerating the ram to deliver a blow to the working tool, the energy storage means being releasably secured to the housing, so that the energy storage means can be removed from the housing and the sleeves can be removed from the casing;

a valve slide, reciprocally disposed around the ram, the valve slide having an upper sealing portion for sealingly engaging the circumference of the bore, and a lower sealing portion for sealingly engaging the ram, thereby dividing the bore into upper, intermediate, and lower chambers;

a shoulder portion of the ram, of an increased diameter, for restricting the flow of hydraulic fluid between the ram and the valve slide when the ram is accelerated toward the working tool;

a high pressure hydraulic fluid inlet port for supplying high pressure fluid to the intermediate annular chamber to force the lower sealing portion of the valve slide into sealing engagement with the piston portion of the ram;

an intermediate pressure hydraulic fluid inlet port for supplying intermediate pressure fluid to the lower annular chamber to force the ram and the valve slide away from the working tool when the ram and the valve slide are in sealing engagement;

a return outlet for exhausting fluid from the tool from the upper annular chamber;

a delatch outlet for exhausting fluid from the intermediate annular chamber and out of the tool, wherein periodic opening of said delatch outlet causes said sealing engagement of said valve slide and said ram to be periodically interrupted;

an optional delatch outlet for exhausting fluid from the intermediate annular chamber and out of the tool, by interrupting said sealing engagement of said valve slide from said ram, the optional delatch outlet being longitudinally offset from the outlet means; and externally operated selection means for causing the optional delatch outlet to be open or closed during operation at each predetermined blow rate.

7. A hydraulic impact tool, comprising:

a housing, having a bore;

a working tool, one end of the working tool being mounted within the bore;

a ram, reciprocally disposed within the housing;

energy storage means for accelerating the ram to deliver a blow to the working tool;

a valve slide, reciprocally disposed around the ram, the valve slide having an upper sealing portion for sealingly engaging the circumference of the bore, and a lower sealing portion for sealingly engaging the ram, thereby dividing the bore into upper, intermediate, and lower chambers;

a high pressure hydraulic fluid inlet port for supplying high pressure fluid to the intermediate annular chamber to force the lower sealing portion of the valve slide into sealing engagement with the ram;

an intermediate pressure hydraulic fluid inlet port for supplying intermediate pressure fluid to the lower annular chamber to force the ram and the valve slide away from the working tool when the ram and the valve slide are in sealing engagement;

outlet means for exhausting fluid from the upper annular chamber and the intermediate annular chamber and out of the tool, wherein periodic opening of one of said outlet means causes said sealing engagement of said valve slide and said ram to be periodically interrupted;

an optional delatch outlet for exhausting fluid from the intermediate annular chamber and out of the tool, by interrupting said sealing engagement of said valve slide from said ram; and an externally operated hydraulic valve, for causing the optional delatch outlet to be open or closed during operation at each predetermined blow rate.

8. A hydraulic impact tool, comprising:

a housing, having a bore;

a working tool, one end of the working tool being mounted within the bore;

a ram, reciprocally disposed within the housing;

energy storage means for accelerating the ram to deliver a blow to the working tool;

a valve slide, reciprocally disposed around the ram, the valve slide having an upper sealing portion for sealingly engaging the circumference of the bore, and a lower sealing portion for sealingly engaging the ram, thereby dividing the bore into upper, intermediate, and lower chambers;

a high pressure hydraulic fluid inlet port for supplying high pressure fluid to the intermediate annular chamber to force the lower sealing portion of the valve slide into sealing engagement with the ram;

an intermediate pressure hydraulic fluid inlet port for supplying intermediate pressure fluid to the lower annular chamber to force the ram and the valve slide away from the working tool when the ram and the valve slide are in sealing engagement;

a return outlet for exhausting fluid from the tool from the upper annular chamber;

a delatch outlet for exhausting fluid from the intermediate annular chamber and out of the tool, wherein periodic opening of said delatch outlet causes said sealing engagement of said valve slide and said ram to be periodically interrupted;

an optional delatch outlet for exhausting fluid from the intermediate annular chamber and out of the tool, by interrupting said sealing engagement of said valve slide from said ram; and an externally operated hydraulic valve, for causing the optional delatch outlet to be open or closed during operation at each predetermined blow rate.

* * * * *